United States Patent [19]

Teschner et al.

[11] 4,175,931

[45] Nov. 27, 1979

[54] ABRASIVE MATERIAL AND PROCESS FOR MANUFACTURING THE SAME

[75] Inventors: Eckart Teschner, Hunstetten-Limbach; Harald Riedel, Mainz; Richard Sattelmeyer, Schlangenbad-Georgenborn, all of Fed. Rep. of Germany

[73] Assignee: Hoechst Aktiengesellschaft, Frankfurt, Fed. Rep. of Germany

[21] Appl. No.: 837,929

[22] Filed: Sep. 29, 1977

[30] Foreign Application Priority Data

Oct. 2, 1976 [DE] Fed. Rep. of Germany ..... 2644552

[51] Int. Cl.[2] ..... B24D 3/28

[52] U.S. Cl. ..... 51/297; 34/24; 34/160; 51/298; 260/29.3; 427/177; 427/179; 427/205; 427/374 A; 427/378; 427/380

[58] Field of Search ..... 427/204, 205, 177, 179, 427/378, 374 A, 380; 260/29.3; 51/298, 297; 34/24, 160

[56] References Cited

U.S. PATENT DOCUMENTS

| | | | |
|---|---|---|---|
| 1,530,873 | 3/1925 | Williams | 34/24 X |
| 1,962,603 | 6/1934 | Lovell | 427/177 |
| 2,736,107 | 2/1956 | Dungler | 34/160 |
| 2,890,948 | 6/1959 | Fantl et al. | 51/298 |
| 3,607,598 | 9/1971 | Le Blanc et al. | 260/29.3 X |
| 3,619,150 | 11/1971 | Rinker et al. | 51/298 X |

*Primary Examiner*—Evan K. Lawrence

*Attorney, Agent, or Firm*—Littlepage, Quaintance, Murphy, Richardson and Webner

[57] ABSTRACT

An abrasive material and process for manufacturing the same. The process comprises: (i) applying a basic binder layer to a flexible support; (ii) scathering abrasive particles onto the basic binder layer; (iii) drying and subsequently cooling the resultant product; (iv) applying a second binder layer as a sizer to the cooled product of step (iii); (v) drying and cooling the sizer; (vi) loosely rolling up the product of step (v); and (vii) curing and subsequently cooling the product of step (vi) by passing a heating or cooling air stream substantially axially through the rolled-up product. The basic and second binder layers each comprise an aqueous mixture of (A) at least one predominantly ortho-structural resol having a molar ratio of phenolic component to formaldehyde of from 1:(1.1 to 2.5), and (B) at least one polyvinyl alcohol in an amount of from 5 to 30% by weight based on the weight of solid phenolic resin.

9 Claims, No Drawings

ABRASIVE MATERIAL AND PROCESS FOR MANUFACTURING THE SAME

BACKGROUND OF THE INVENTION

This invention relates to a process for the manufacture of an abrasive bonded to a flexible support using aqueous mixtures of a resol and a polyvinyl alcohol as binders.

Abrasives bonded to a flexible support, such as, for example, emery paper, abrasive cloth, abrasives with combinations of cloth and paper and abrasive fibres, are usually manufactured in such a way that the support material is in the form of a web approximately 1 to 1.5 m wide and up to several kilometers long, and are provided on one side with a thin film of a liquid binder, known as the basic binder. The abrasive particles are scattered in this basic binder film, generally electrostatically whereby the abrasive particles are in a desired orientation with their longitudinal axes at right angles to the surface of the support material. After the particles have been scattered, the resulting intermediate product is subjected to a heat treatment, by passing through a heating duct, whereby the binder is dried or cured. In general, the binder must be solidified to the extent that the abrasive particles cannot be displaced or broken away during any further treatment. Depending on the particle size, upon which the layer thickness of the binder depends, this heat treatment generally, lasts from 0.5 to 3 hours, during which the temperature is raised from about 20° C. to 110°-120° C. in definite steps. Then a second stronger binder layer, known as sizer, is applied, which generally contains calcium carbonate filler, and which is then similarly heat treated in a heating duct at a temperature of 20° C. rising to 120°-130° C. for 3 to 6 hours until curing is effected.

In order to achieve high production with such long heat treatment times, the heating ducts have to be designed in the form of suspended ducts (heated with circulating hot air), such as loop or festoon dryers, which have lengths up to 100 m for a pre-drying hanging zone (intermediate hanging zone) and up to several hundred meters for the main hanging zone. Investment costs for suspended ducts are very high due to their expensive construction and the size of the installations. Despite the high outlay, loop dryers have however, a series of inherent defects which considerably complicate or render impossible the maintenance of a consistent quality for the products.

To maintain a uniform temperature distribution, the particular dimensions of the suspended ducts produces a problem which can be only inadequately solved despite refined air-circulation and heating techniques. Increasing the blowing rate of the hot air should, in principal, reduce the drop in temperature to a manageable degree, but, in practice, is limited by the relatively unstable suspension of the web. Varying degrees of curing over short portions of and a partially blistered structure of the binder layers are the frequent result of the drop in temperature which unavoidably occurs. These undesired effects can be minimised by a careful increase in temperature, although this leads, in turn, to lengthening of the process and, consequently, an extension of the ducting installations.

Quality is also reduced by the effect of the vertical arrangement of the abrasive material in the loop dryer. If the synthetic resin binder is liquified too greatly by a more rapid increase in temperature, it tends to flow and the originally perpendicular abrasive particles turn over and/or are displaced thereby causing disadvantages in respect of the abrasion characteristics of the product. Additionally, the more or less sharp bends at the tops or bottoms of the loops give rise to potential faults or fractures after subsequent stretching of the web.

Horizontal drying units do not present these disadvantages so that such units are highly suitable for the processing of quick-drying or quick-gelling binders, e.g. hide-glue or urea-formaldehyde resins. Hitherto, it has not been possible to process aqueous-liquid resols in horizontal drying units with an economically acceptable throughput rate, due to the long drying times required, so that horizontal drying ducts of 400 to 500 m in length have been required for a continuous drying operation.

It has been proposed to shorten the long drying processes required for phenolic resin binders used in the manufacture of flexible abrasives in loop drying installations by adding polyvinyl alcohol (PVAL) in aqueous solution or cellulose derivatives, starch or starch derivatives, to a phenolic resin capable of dilution in water. Although it has been possible to partially shorten the drying times, the temperatures used were not more than 100° C. If the proportion of any additives present becomes too large or if the solids content has to be sharply reduced owing to the excessive viscosity of the binder, abrasives of low quality are obtained.

Tests have shown that attempts to shorten drying times of phenolic resin binders down to acceptable times of less than 5 minutes by raising the drying temperatures to 110°-130° C. have failed, as the phenolic resins suffered severe blistering and insufficient binding of the abrasive particles to the support was achieved.

These disadvantages show that an improved method is required to effect the process of drying and curing abrasives bonded in phenolic resins. It is also desirable to avoid the use of a loop dryer which is uneconomical with regard to capital expenditure and operation in such processes.

SUMMARY OF THE INVENTION

According to one aspect of the present invention there is provided a process for the manufacture of an abrasive material which comprises the steps (i) applying a basic binder layer to a substantially flat flexible support;

(ii) scattering abrasive particles onto the said basic binder layer;

(iii) drying the product of step (ii) in a horizontal drying unit having an air temperature of from 100° to 140° C. and subsequently cooling the product in an air stream having a temperature of not more than 40° C., the drying process being effected for a time sufficient to allow the said basic binder layer to attain sufficient adhesive strength to prevent displacement of the abrasive particles disposed therein when the product is cooled;

(iv) applying a second binder layer (defined as sizer) to the cooled product of step (iii);

(v) drying the sizer in a horizontal drying unit having an air temperature of from 100° to 140° C. and subsequently cooling the product in an air stream having a temperature of not more than 40° C., the drying process being effected for a time sufficient to allow the said sizer to become imprint resistant (as herein defined);

(vi) loosely rolling-up the product of step (v);

curing the product of step (vi) by gradual heating to 110° to 140° C. followed by gradual cooling to a temperature of about 50° C., wherein the gradual heating and gradual cooling is effected by passing a heating or cooling air stream, as required, substantially axially through the rolled-up product;

wherein the said basic and second binder layers each comprise an aqueous mixture of (A) at least one predominantly orthostructured resol having a molar ratio of phenolic component to formaldehyde of from 1:(1.1 to 2.5), and (B) at least one polyvinyl alcohol in an amount of from 5 to 30% by weight, based on the weight of solid phenolic resin.

In steps (iii) and (v) of the present invention, drying of the basic and second binder layers is preferably effected in a horizontal drying unit equipped with air-injection nozzles whereby the heated drying air is introduced into the drying unit.

DESCRIPTION OF THE PREFERRED EMBODIMENTS

In the process according to the invention, drying of the basic binder layer having abrasive particles disposed therein, is carried out, after scattering of the abrasive, in the horizontal drying unit preferably at a temperature of 120° to 130° C.; a combination of phenolic resin and polyvinyl alcohol preferably additionally comprising a filler is then applied continuously as a sizer and immediately dried, also in a horizontal drying unit. After drying, the product is cooled by an air stream, having a temperature of not more than 40° C., preferably to 10° to 25° C., down to 20° to 40° C., preferably down to 25° to 30° C., preferably in less than 5 minutes, advantageously in less than 3 minutes, and most preferably in less than 1 minute. The abrasive web is then wound loosely into a coil and, in order to effect curing of the binder layers, is generally placed in a heated chamber in which air circulates. The hot air stream is directed so that it flows substantially axially through the loose coil. Curing in the heat chamber takes place according to a temperature-time curve such that the temperature rises over advantageously 2 to 15 hours, preferably 5 to 10 hours gradually from about 20° C. to between 110° C. and 140° C., preferably to 120° C. and then falls again linearly over advantageously 5 to 20 hours, preferably 7 to 16 hours, to not more than 60° C. (preferably to not more than 50° C.). Following curing, reconditioning of the material is generally carried out, the duration of which depends on the material and is generally 2 to 48 hours. Curing and reconditioning may be carried out in the same or a separate chamber. Compared with the loop dryers used hitherto, the use of such heat chambers is distinquished by their lower cost and also by the smaller amount of space which they require.

Drying of the sizer in step (v) of the present invention is carried out for a time sufficient to allow this layer to become "imprint resistant." By this term, as used herein, it is intended that the sizer no longer leaves any trace of binder on a piece of white paper pressed to the layer by finger pressure.

The phenolic resins used in the present invention preferably have a ratio of phenolic component to formaldehyde of from 1:1.3 to 1:2.2, most preferably 1:1.5 to 1:1.9 and are predominantly ortho-structured and have the properties of very rapid drying times and a very low tendency to blistering. Phenol, $C_6H_5OH$, is preferably used to make the resol, although up to 70% by weight of the quantity of phenol can be replaced by alkyl phenols with up to four carbon atoms in the alkyl group. These alkyl phenols are generally substituted in the m-position, but can also have a minor content of o- and p-compounds. The use of phenolic resins in the manufacture of abrasives is generally characterized by the presence of a high resin concentration in conjunction with a relatively low viscosity. The solids content of the binders for use in the present invention is generally at least 55%, preferably at least 60%, and advantageously 65 to 70% by weight (in relation to the total combination) and the viscosity at 20° C. is generally not more than 5000, preferably 100 to 3500, and advantageously 1500 to 2500 mPa.s, in order to guarantee optimum embedding of the abrasive particles therein. These values are also desirable to enable the layer thickness to be consistently controlled by the coating units.

To prepare the binders used in the present invention the resol has added to it at least one polyvinyl alcohol having a molecular weight desirably of 50,000 to 200,000, and preferably 100,000 to 150,000, in quantities of 5 to 30, preferably 10 to 20% by weight in relation to solid phenolic resin. This addition can be effected either directly following the condensation reaction of the phenolic component and formaldehyde, or, also, by mixing with the resol shortly before processing. To achieve a high solids content in the binders, it is appropriate to add the polyvinyl alcohol(s) preferably in solid form to the aqueous solution of the resol. The mixture then possesses the previously specified solids contents and viscosities.

Conventionally used materials, such as sand, silicon carbide, granulated alumina and the like, are suitable as abrasive particles for the present invention.

The sizer preferably additionally comprises one or more fillers, such as, for example, calcium carbonate in the form of calcite, chalk or prepared chalk, kaolin and barium sulphate.

Flat-track drying units e.g. flat-bed dryers and horizontal heating ducts, are particularly suitable as horizontal drying units for sharply accelerated drying (shock drying) in the present invention.

For drying the basic and second binder layers the web may be passed through the horizontal drying unit horizontally or in a slightly convex way and may be guided, for example, on reels, rollers, conveyor belts or air cushions. In contrast to conventional flat-track dryers, and especially to loop dryers, the horizontal drying unit is preferably provided with hot-air nozzles with a very small uniform spacing from the abrasive web, thus guaranteeing high circulation efficiency and high blowing rates for the hot air, together with a minimum air volume in the duct. The small volume is achieved by having a low duct height such as 10 to 60 cm, and preferably 15 to 40 cm. Slit-shaped blowing nozzles conveniently extend at right angles to the direction of movement of the abrasive web and generally over the full web width. They may be alternated with similarly slit-shaped suction openings. The blowing and suction slits can be arranged individually or in pairs. The nozzles may be provided at a spacing of, for example, 2 to 30 cm, preferably 4 to 10 cm above and, optionally, also below the web. Variations in temperature at right angles to the direction of movement of the web are thus avoided by the arrangement and mode of operation described, so that at each drying stage the phenolic resin binders can be treated with a maximum permissible quantity of heat and temperature, limited by the incidence of blisters in the binder, and consequently, can be dried and also cured in the shortest possible time. By this arrangement the supply of high quantites of heat and thus a high drying rate is made possible in the first stage, without the risk arising that the phenolic resin, liquefied by the rapid rise in temperature, will flow off.

It does not matter whether the desired solidification of the individual layers is achieved by physical drying and/or molecular enlargement, i.e. curing. It is, however, important that solidification takes place under the conditions according to the invention, with the avoidance of foaming and blistering or other structural defects in the binder layers and, further, that the thermal-mechanical properties of the cured synthetic resin binders are maintained or improved, thus ensuring that better or at least equally good products corresponding to the state of the art are obtained.

In the following Examples the process according to the present invention is compared with a known process for the manufacture of abrasives carried out on a loop drying unit at lower temperatures than in the present invention.

In the Examples T represents parts by weight and percentages are percentages by weight.

Preparation of the Resol

70 T of calcium hydroxide are stirred with 1600 T of phenol at 60° C. and reacted over 60 minutes with 2000 T of 40% aqueous formaldehyde, the temperature being controlled by the rate of addition of formaldehyde, and if necessary also by cooling, to 60° to 65° C. This temperature range is maintained until the content of free formaldehyde falls below 2%. Water is then distilled off under reduced pressure at approximately 50° C. until the content of dry residue has risen to approximately 70%. Viscosity (20° C., capillary method to DIN 53 177) 700 mPa.s, B stage-time at 120° C. (hot plate): 7 minutes, pH value 8.5

EXAMPLE 1

Basic binder: 100 T of resol are heated in 15 T of water to 50° C., 10 T of polyvinyl alcohol, molecular weight approximately 150,000, are introduced by vigorous stirring and the mixture is cooled to 25° C. after stirring for 30 minutes at 50° C. Viscosity at 20° C.: 1700 mPa.s, baking reisdue (1 hour at 135° C.) 69%.

Sizer: 60 T of the basic binder described above are mixed at 20° C. with 40 T of finely ground calcite (main grain fraction size 5 to 10 μm) and 10 T of water. Viscosity (20° C.): 2100 mPa.s, baking residue (135° C.) 73%.

Preparation of the abrasive: A vulcanised fibre sheet made especially for the abrasive industry with a thickness of 0.8 mm and a weight per unit area of approximately 1000 g/m$^2$ is coated by a roll coater with the basic binder in a wet film thickness of 75 μm and then standard corundum (fused alumina) of grain 80 in a quantity of 400 g/m$^2$ is electrostatically scattered thereon. This coated web is then passed in 2.5 minutes through a flat-track dryer having hot-air slit nozzles arranged at right angles to the direction of movement of the web at a spacing of 5 cm above the web and from which air heated to 130° C. blows onto the coating perpendicularly or slightly obliquely from above. The heating zone of the horizontal duct is followed immediately by a cooling zone in which cold air cools the heated abrasive web to approximately 30° C. in 1 minute.

The sizer is then applied by a roll coater in a quantity of 200 g/m$^2$ in wet application and is dried as above in a flat-track dryer in 2.5 minutes at 130° C. and then cooled in 1 minute to approximately 30° C. and then loosely rolled up. The abrasive coil is then suspended or placed on a grid in a cabinet heated with circulating air, the hot air being directed axially through the coil by a suitable device, for example a peripherally mounted sleeve of heat-resistant, air-tight fabric (this process being known as "roll curing"). The coil is then heated from 20° C. to 120° C. in a linearly ascending trend over 10 hours and then cooled to 60° C. over 8 hours in a linearly descending temperature curve. By supplying moist steam to the air circuit the absolute water content of the air of the cabinet is subsequently adjusted to approximately 15 g/m$^3$ and kept at this value for 48 hours. The temperature is allowed to drop to 22° C. during this time.

EXAMPLE 2

Basic binder: 100 T of the resol used in Example 1 are mixed at 20° C. with 85 T of a 30% solution of a polyvinyl alcohol (molecular weight approximately 150,000). Viscosity (20° C.): 4000 mPa.s, baking residue (1 hour/135° C.): 55%

Sizer: 75 T of the basic binder described above are stirred at 20° C. with 40 T of calcite and 25 T of water. Viscosity (20° C.): 5000 mPa.s, baking residue (1 hour/135° C.): 58%.

Comparative Example 1

Analogously to the process in Example 1, an abrasive web is made from a resol which is, however, known to be quick-drying in the abrasive industry, and is a low-alkaline condensation product of phenol and formaldehyde in an aqueous solution with the following characteristics:

Viscosity at 20° C. = 900 mPa.s, baking residue 1 hour at 135° C. = 75%, pH value = 9, B stage-time at 120° C. = 9 minutes.

It is used in the form supplied as a basic binder without the addition of a polyvinyl alcohol.

Sizer: 55 T of phenol resin, 40 T of calcite and 5 T of water are mixed as in Example 1. Viscosity (20° C.) 900 mPa.s, baking residue (1 hour/135° C.): 81%.

The basic binder is applied in a layer thickness of 75 μm and coated with the sizer in a quantity of 170 g/m$^2$ subject to the solids proportion.

Comparative Examples 2 and 3

Examples 1 and 2 are repeated, curing being carried out according to German OLS 16 94 123, Example 1. For this, the coated dried vulcanised fibre sheet material undergoes heat treatment for about 24 hours in a loop dryer, the air temperature being increased from 50° to 93° C. during the first four hours and then kept at around 80° C. for 20 hours. Grinding wheels are stamped from the coated vulcanised fibre sheet having an outside diameter of 178 mm and an inside diameter of 22 mm, these are flexed crosswise on a roll flexing machine and then subjected to a sanding test based on the principal of "edge polishing." Thus, the vulcanised fibre sheet grinding wheels are pressed at an angle of incidence to their plane of rotation of 25° with an applied pressure of 80 N onto the edge of a 3 mm thick Cr—Ni steel sheet. The rate of revolution is 3200 rev/min and the grinding period is 9 minutes. The weight loss V of the grinding wheels and the weight A of the removed steel are measured. The performance value I is the quotient of A/V.

TABLE

| Example | 1 | 2 | Compar. 1 | Compar. 2 | Compar. 3 |
|---|---|---|---|---|---|
| Characteristics of Binders | | | | | |
| PVAL proportion in solid (% by weight) | 12.5 | approx 27 | — | 12.5 | approx 27 |
| Basic binder (without filler) | | | | | |
| Viscosity at 20° C. (mPa.S) | 1700 | 4000 | 900 | 1700 | 4000 |
| Proportion of solids (%) | 69 | 55 | 75 | 69 | 55 |
| Sizer | | | | | |
| (solid resin: Filler = 1:1) | | | | | |
| Viscosity at 20° C. (mPa.S) | 2100 | 5000 | 1050 | 2100 | 5000 |
| Proportion of solids (%) | 73 | 58 | 81 | 73 | 58 |
| Time required for quick drying at 130° C. for binder layer (min.) | 2.5 Blister-free | 2.5 Blister-free | After 4 min. test suspended as product blisters | 2.5 Blister-free | 2.5 Blister-free |
| final curing of binders | Roll curing | | | Loop Dryer | |
| | 10 h 20°→120° C. 8 h 120°→60° C. | | | 4 h 50°→93° C. 20 h 80° C. | |
| Sanding test | | | | | |
| Weight of removed steel (A) (g) | 42 | 35 | — | 14 | 19 |
| Weight loss of grinding wheel (V) (g) | 6.2 | 8.2 | — | 12.0 | 15.8 |
| Performance value I (A/V) | 6.8 | 4.3 | | 1.2 | 1.2 |

We claim:

1. A process for the manufacture of an abrasive material which comprises the steps
   (i) applying a basic binder layer to a substantially flat flexible support;
   (ii) scattering abrasive particles onto the said basic binder layer;
   (iii) drying the product of step (ii) in a horizontal drying unit having an air temperature of from 100° to 140° C. and subsequently cooling the product in an air stream having a temperature of not more than 40° C., the drying process being effected for a time sufficient to allow the said basic binder layer to attain sufficient adhesive strength to prevent displacement of the abrasive particles disposed therein when the product is cooled;
   (iv) applying a second binder layer as sizer to the cooled product of step (iii);
   (v) drying the sizer in a horizontal drying unit having an air temperature of from 100° to 140° C. and subsequently cooling the product in an air stream having a temperature of not more than 40° C., the drying process being effected for a time sufficient to allow the said sizer to become imprint resistant;
   (vi) loosely rolling up the product of step (v); and
   (vii) curing the product of step (vi) by gradual heating to 110° to 140° C. followed by gradual cooling to a temperature of about 50° C., wherein the gradual heating and gradual cooling is effected by passing a heating or cooling air stream, as required, substantially axially through the rolled-up product;
   wherein the said basic and second binder layers each comprise an aqueous mixture with solids content of at least 55% by weight, based on the total composition, and a viscosity of no more than 5,000 mPa.s of (A) at least one predominantly ortho-structured resol having a molar ratio of phenolic component to formaldehyde of from 1:(1.1 to 2.5), and (B) at least one polyvinyl alcohol in an amount of from 5 to 30% by weight, based on the weight of solid phenolic resin.

2. A process as claimed in claim 1 wherein the drying processes of steps (iii) and (v) are effected in not more than 5 minutes.

3. A process as claimed in claim 1 wherein component (B) has a molecular weight of from 50,000 to 200,000.

4. A process as claimed in claim 1 wherein the phenolic component in component (A) contains up to 70% by weight based on the quantity of phenol of at least one alkylphenol containing up to 4 carbon atoms in the alkyl group.

5. A process as claimed in claim 1 wherein the sizer comprises a filler.

6. A process as claimed in claim 1 wherein the curing in step (vii) is effected over a period of from 2 to 15 hours.

7. A process as claimed in claim 1 wherein the cooling step following curing in step (vii) is effected in a period of from 5 to 20 hours.

8. A process as claimed in claim 1 wherein the horizontal drying unit of steps (iii) and (v) is equipped with slit-shaped blowing nozzles conveniently extending at right angles to the direction of movement of the support material and substantially over the full width from which an air stream of from 100° to 140° C. is blown towards the coating from above, said blowing nozzles being alternated with similarly slit-shaped suction openings.

9. An abrasive material prepared by a process as claimed in claim 1.

* * * * *